US006647690B1

(12) United States Patent
Martensson

(10) Patent No.: US 6,647,690 B1
(45) Date of Patent: Nov. 18, 2003

(54) FLOORING MATERIAL, COMPRISING BOARD SHAPED FLOOR ELEMENTS WHICH ARE INTENDED TO BE JOINED VERTICALLY

(75) Inventor: Goran Martensson, Klagstorp (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 09/890,978

(22) PCT Filed: Sep. 27, 1999

(86) PCT No.: PCT/SE99/01700

§ 371 (c)(1),
(2), (4) Date: Nov. 5, 2001

(87) PCT Pub. No.: WO00/47841

PCT Pub. Date: Aug. 17, 2000

(30) Foreign Application Priority Data

Feb. 10, 1999 (SE) ..... 9900432

(51) Int. Cl.[7] ..... E04C 1/10

(52) U.S. Cl. ..... 52/601; 52/489.1; 52/591.1; 52/578

(58) Field of Search ..... 52/480, 588.1, 52/592.2, 489.1, 578, 591.1, 601

(56) References Cited

U.S. PATENT DOCUMENTS

| | | | | |
|---|---|---|---|---|
| 2,004,193 A | | 6/1935 | Cherry | |
| 2,740,167 A | * | 4/1956 | Rowley | 52/591.1 |
| 3,479,784 A | * | 11/1969 | Massagli | 160/235 |

(List continued on next page.)

FOREIGN PATENT DOCUMENTS

| | | |
|---|---|---|
| BE | 1010487 | 12/1999 |
| CA | 991373 | 6/1976 |
| DE | 2159042 | 6/1973 |
| DE | 2238660 | 2/1974 |
| DE | 3343601 | 6/1985 |
| DE | 3343601 | 2/1987 |
| GB | 812671 | 4/1959 |
| GB | 1348272 | 3/1974 |
| GB | 1430423 | 3/1976 |
| GB | 2256023 | 11/1992 |
| JP | 3169967 | 7/1991 |
| SE | 501014 | 10/1994 |
| SE | 502994 | 3/1996 |
| SE | 502994 | 9/1996 |
| WO | 9313280 | 7/1993 |
| WO | 9747834 | 12/1997 |
| WO | 9966151 | 12/1999 |
| WO | 0063510 | 10/2000 |

OTHER PUBLICATIONS

Pending U.S. patent application Ser. No. 09/672,077.
Pending U.S. patent application Ser. No. 09/988,014.
Pending U.S. patent application Ser. No. 09/770,395.
Pending U.S. patent application Ser. No. 10/158,945.
Pending U.S. patent application Ser. No. 09/672,076.

*Primary Examiner*—Carl D. Friedman
*Assistant Examiner*—Basil Katcheves
(74) *Attorney, Agent, or Firm*—Stevens, Davis, Miller & Mosher, L.L.P.

(57) ABSTRACT

Flooring material including floor boards (1) with an essentially square, rectangular or rhomboidal shape. The floor boards (1) are provided with edges (2), a horizontal lower side (5) and a horizontal decorative upper surface (3). The floor boards (1) are provided with lower joining lips (10) at two adjacent edges (2) while the two remaining edges (2) are provided with upper joining lips (20). The lower joining lips (10) are provided essentially vertical lower lip surfaces 911) arranged parallel to the closest edge (2). The lower lip surfaces (11) are intended to interact with mainly vertical upper lip surfaces (21) arranged on the upper joining lips (20). Two joined adjacent floor boards (1) are hereby locked together in a horizontal direction. The joining lips (10 and 20 respectively) are furthermore provided with one or more heels (31) intended to snap join with recesses (32) adapted thereto which, by being provided with essentially horizontal locking surfaces, limits vertical movement between two joined adjacent floor boards (1).

23 Claims, 3 Drawing Sheets

U.S. PATENT DOCUMENTS 3,553,919 A * 1/1971 Omholt ..... 52/480
3,720,027 A 3/1973 Christensen
3,798,111 A 3/1974 Lane et al.
3,807,113 A 4/1974 Turner
3,859,000 A 1/1975 Webster
3,921,312 A 11/1975 Fuller
4,426,820 A * 1/1984 Terbrack et al. ..... 52/594
4,449,346 A 5/1984 Tremblay
4,940,503 A 7/1990 Lindgren et al.
5,092,095 A * 3/1992 Zadok et al. ..... 52/593
5,148,850 A 9/1992 Urbanick
5,216,861 A 6/1993 Meyerson
5,295,341 A 3/1994 Kajiwara
5,325,649 A 7/1994 Kajiwara
5,344,700 A 9/1994 McGath et al.
5,348,778 A 9/1994 Knipp et al.
5,502,939 A 4/1996 Zadok et al.
5,630,304 A 5/1997 Austin
5,706,621 A 1/1998 Pervan
5,797,237 A 8/1998 Finkell, Jr.
5,860,267 A 1/1999 Pervan
5,907,934 A 6/1999 Austin
6,006,486 A 12/1999 Morian
6,023,907 A 2/2000 Pervan
6,094,882 A 8/2000 Pervan
6,101,778 A 8/2000 Martensson
6,182,410 B1 2/2001 Pervan
6,205,639 B1 3/2001 Pervan
6,209,278 B1 4/2001 Tychsen
6,216,409 B1 4/2001 Roy et al.
6,314,701 B1 * 11/2001 Meyerson ..... 52/588
6,324,803 B1 12/2001 Pervan
6,397,547 B1 6/2002 Martensson
6,418,683 B1 7/2002 Martensson et al.
6,421,970 B1 7/2002 Martensson et al.
6,438,919 B1 8/2002 Knauseder

* cited by examiner

FLOORING MATERIAL, COMPRISING BOARD SHAPED FLOOR ELEMENTS WHICH ARE INTENDED TO BE JOINED VERTICALLY

The present invention relates to a flooring material comprising board shaped floor elements which are intended to be joined vertically.

Prefabricated floor boards which are provided with tongue and groove at the edges are well known today. As these are rather easy to install, this can be achieved by the average handy man. Such floors can be made of solid wood, particle board or fibre board. These floor boards are most often provided with a top surface, such as lacquer or some kind of laminate. The board are most often joined by being glued together via their tongue and groove. The most common types of floor boards are, however, burdened with the disadvantage to form gaps of varying width between the floor boards if the installer is not thorough enough. Dirt will accumulate in such gaps. Moisture will furthermore enter the joints which will cause the core to expand in cases where it is made of solid wood, fibre board or particle board which usually is the case. This expansion will cause the top surface to rise closest to the joint, which radically decreases the useful life of the floor due to increased wear on the protruding edges of the floor board. In order to avoid this type of gaps it is known to use different type of tensioning devices used for clamping the floor boards together during installation. This operation is, however, rather awkward and it is desirable to achieve a floor board with a joint which is self-orienting and thereby automatically will find its correct position. It would also be possible to use such a joint without having to use glue.

The above mentioned problems have been solved through the present invention whereby a floor that is easy to install has been achieved. Accordingly, the invention relates to a flooring material including floor boards with an essentially square, rectangular or rhomboidal shape. The floor boards are provided with edges, a horizontal lower side and a horizontal decorative upper surface. The floor boards are provided with lower joining lips at two adjacent edges while the two remaining edges are provided with upper joining lips. The invention is characterised in that the lower joining lips are provided with essentially vertical lower lip surfaces arranged parallel to the closest edge which lower lips surfaces are intended to interact with mainly vertical upper lip surfaces arranged on the upper joining lips. Two joined adjacent floor boards are hereby locked together in a horizontal direction. The joining lips are furthermore provided with one or more heels intended to snap-join with recesses adapted thereto which, by being provided with essentially horizontal locking surfaces, limits vertical movement between two joined adjacent floor boards.

The joint between two floor boards joined together, preferably includes fitting surfaces which are comprised by the horizontal locking surfaces on the recesses and the heels, the vertical upper lip surfaces and upper fitting surfaces. The joint between two floor boards joined together suitably also includes cavities.

According to one embodiment of the invention the heel is constituted by a resilient part which is arranged in a cavity. The recess is alternatively constituted by a resilient part which is arranged in a cavity. Such a resilient part may suitably be constituted by an extruded thermoplastic profile, a profile made of thermosetting resin or an extruded or a cold forged profile made of metal or the like.

These resilient parts may be handled in different ways. One suitable way is to pre-mount these into cavities intended for the purpose. The resilient part will hereby be in the correct position when the floor is to be installed. The material chosen will, however, be limited somewhat since some of the floor boards will have to be cut in connection to the installation as the floor board and the resilient part will have to be cut simultaneously. Thinner profiles made of brittle materials, such as thermosetting resins, might for example shatter if cut with an ordinary fog saw, while for example steel is practically impossible to cut with such a tool. Since the floor board itself usually comprises a core of fibreboard or particleboard with a surface of thermosetting laminate the choice of cutting tools will be somewhat limited. Aluminium, or a thermoplastic material such as polypropylene, polyethylene, poly amide or polystyrene, advantageously containing a filler, is therefore suitable where a pre-assembled resilient part is desired. Pre-assembled resilient parts does suitably have a length only a bit shorter than the side on which they are mounted. A prevalent dimension on the floor board is 200×1200 mm.

It is also possible to mount the resilient part during the installation of the floor. The choice of material in the resilient parts will hereby be more free as they may be manufactured in different, and shorter lengths. It hereby becomes possible to choose spring steel which will provide an excellent locking. Suitable lengths of post-assembled resilient part may be from a few centimeters to a couple of decimeters.

The flooring material comprising the above floor board is very suited when installing floors where no glue is to be used. It is, of course, possible to utilise glue or adhesive tape to make the installation irreversibly permanent. The glue or tape is then suitably applied in, or in connection to, possible cavities before joining the floor boards.

Floor boards according to present invention are, unlike common types of floor boards, joined by being pressed downwards. Commonly known floor boards are assembled horizontally by being forced or knocked together. Some known floor boards are assembled by being turned or prized into position. These known floor boards are guided vertically, and in a few cases also horizontally, on a great number of variations on the tongue-and-grove theme. It is very difficult to apply sufficient horizontal force manually at floor level whereby different types of tensioning devices are essential when installing such floors. The installer will only have to apply some of his body weight over the joint and the floor boards will snap together, when installing floors according to the present invention. It is hereby becomes possible walk the floor boards into position once they are placed correctly.

It is also possible to install the floor standing up by using very simple tools, for example a couple of rods with a suction cup at the lower ends. It would thereby be possible to install the floor without having to crawl on ones knees. Industrial injuries such as back and knee problems are very common among floor installers.

The invention is explained further together with enclosed drawings showing different embodiments of the invention whereby, FIG. 1 shows an embodiment of two opposite edges 2 of a floor board 1 according to the present invention. These are shown in cross-section in order to facilitate understanding of the invention.

FIGS. 2*a* and 2*b* show a second embodiment of the invention. FIG. 2*a* shows, in cross-section, the two adjacent edges 2 of two floor boards 1 before assembly while FIG. 2*b* shows the same two floor boards 1 after being joined.

FIGS. 3*a* and 3*b* show another embodiment of the invention. FIG. 3*a* shows, in cross-section, the two adjacent edges 2 of two floor boards 1 before assembly while FIG. 3*b* shows the same floor boards 1 after being joined.

Figure 1:
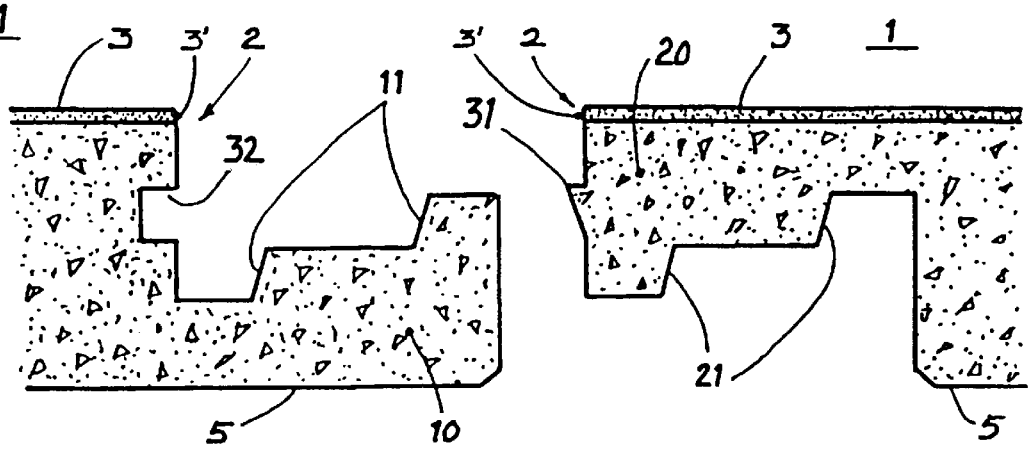

FIG. 1 shows parts of a flooring material comprising floor boards 1. The floor boards 1 are provided with edges 2, a horizontal lower side 5 and a horizontal upper decorative surface 3. The floor boards 1 are at two adjacent edges 2 provided with lower joining lips 10 (only one shown) while the two remaining edges 2 are provided with upper joining lips 20 (only one shown). The lower joining lips 10 are provided with mainly vertical lower lip surfaces 11 arranged parallel to the closest edge 2. The lower lip surfaces 11 are intended to interact with mainly vertical upper lip surfaces 21 arranged on the upper joining lips 20 so that two joined adjacent floor boards 1 are locked together in a vertical direction. The joining lips 10 and 20 respectively are furthermore provided with each one heel 31 with a matching recess 32. A vertical movement between two joined adjacent floor boards 1 is limited since the recess 32 and heel 31 respectively are provided with essentially horizontal locking surfaces. The joining surfaces are also provided with fitting surfaces 3' in order to avoid unintended gaps in the joint. The geometry of the joining edges are only shown schematically and may, of course, be changed in many ways within the scope of the invention.

According to one embodiment of a floor board 1 according to the present invention, the floor boards 1 includes a core which is covered with an upper decorative surface 3. The core most often consists of wood particles or fibre bonded together with glue or resin. Since the core material is sensitive to moisture it may be advantageous to treat the area closest to the joint if the floor is to be exposed to moisture. This treatment may suitably include resin, wax or some kind of lacquer. It will not be necessary to treat the joint if the floor boards 1 are to be glued since the glue itself will protect the joint from moisture penetration. The decorative upper surface consists of a decorative paper impregnated with melamine-formaldehyde resin. One or more layers of so called overlay paper of α-cellulose, impregnated with melaimine-formaldehyde resin is suitably placed on top of the decorative paper. One or more of the above layers may be sprinkled with hard particles, of for example α-aluminium oxide, silicon carbide or silicon oxide in connection to the impregnation in order to improve the abrasion resistance. The paper impregnated with resin is cured before, or in connection to applying it to the core. The paper layers are suitably laminated together before they are applied to the core in cases where the upper decorative surface 3 is constituted by more than one paper layers. The lower side 5 may suitably be coated with a lacquer or a resin impregnated paper. According to another alternative embodiment of the invention the core of the floor board 1 is constituted by a mixture of 4 –6 parts by weight of particles such as wood fibre, with an average particle size in the range 50 μm–3000 μm which is agglomerated with 4–6 parts by weight of a thermoplastic polymer. The particles may partly or completely be constituted by another organic material such as bark, flax, straw, corn starch, fruit stones or the like. It is also possible to partly or completely replace the organic particles with inorganic ones such as stone dust, sand, lime, mica or the like.

The thermoplastic material is suitably constituted by a poly olefin such as polyethylene, polypropylene, or polybutene but can also be constituted by others such as polystyrene, acrylnitril-butadiene-styrene copolymer, poly amid, polyvinyl chloride or poly carbonate.

Additives might be added to the material in order to adapt the elastic and acoustic properties of the core to the desired one. Among such additives can mentioned ethyl-vinyl-acetate, di-ethyl-phthalate, di-isobutyl-phthalate or epoxidated organic oils.

Among possible upper surfaces to the core specified above may be mentioned thermosetting laminates including at least a decorative paper impregnated with melamine-formaldehyde resin. Overlay paper and hard particles may be added to this as described earlier in the present application. The upper decorative surface may also be constituted by an acrylic foil, an acrylic lacquer and combinations thereof. It might also be constituted by a foil or a lacquer of poly olefins or poly olefin derivatives.

An adhesion problem between the different materials included in the floor board might occur in certain combinations. It is possible to overcome these problems which normally present themselves as de-lamination problems, low impact strength or blistering, by adding 0.01–1 part of dendritic macromolecules with a combination of chain terminators adapted to the characteristic materials of the floor board in order to increase the chemical bond between the different materials. It is also possible to coat a decorative surface with an acrylic lacquer containing, or being sprinkled with, hard particles of a-aluminium oxide, silicon carbide or silicon oxide. The coating is most often achieved through use of a roller or through curtain coating. Among suitable acrylic lacquers can be mentioned radiation curing ones which are cured with electron beam or ultraviolet light forming free radicals in the uncured lacquer.

Figure 2A:
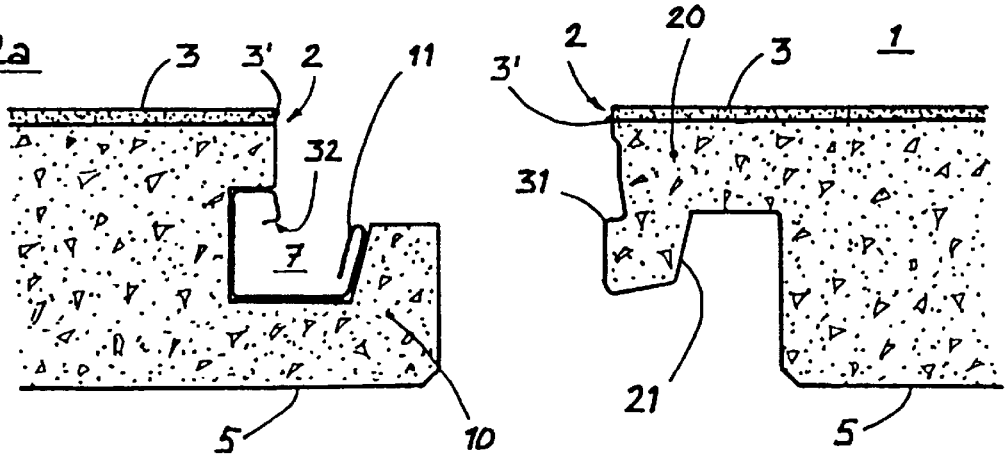
Figure 2B:
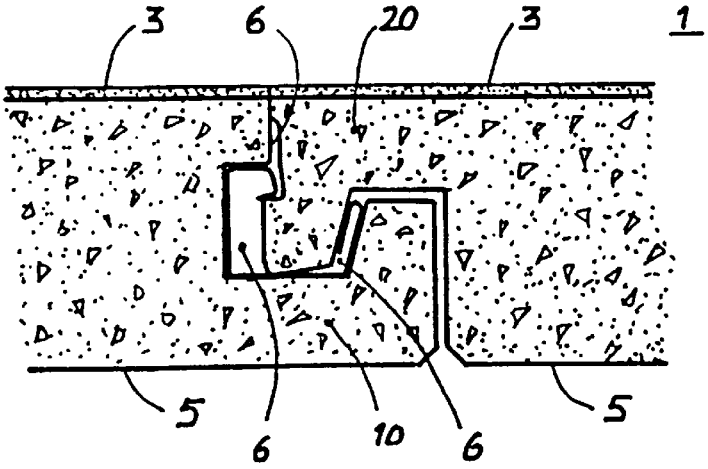

The FIGS. 2*a* and 2*b* show a second embodiment of the invention. FIG. 2*a* shows in cross-section the adjacent edges 2 of two floor boards before joining while FIG. 2*b* shows the same after being joined. The embodiment shown is mainly the same as the one shown in FIG. 1. The embodiment shown in FIG. 2*a–b* is, however, in addition provided with cavities 6 (FIG. 2*b* ) and a resilient part 7. The cavities 6 can for example be found in the finished joint between the contact surfaces that are formed between the horizontal locking surfaces on the recess 32 and the heel 31, the vertical upper lip surface 21 and the lower lip surface 11 together with the upper fitting surfaces 3'. The resilient part 7 is placed in a cavity 6. The resilient part 7 forms a resilient recess 23 and a resilient lower lip surface 11. The cavities 6 reduces the negative effects loose particles might have, which loose particles otherwise might cause undesired gaps in the upper part of the joint. The cross-section geometry of the joint is only shown schematically focusing on the interaction between the different surfaces in order to facilitate understanding of the invention. Then invention is not limited to the embodiment as it can be varied within the scope of the invention.

Figure 3A:
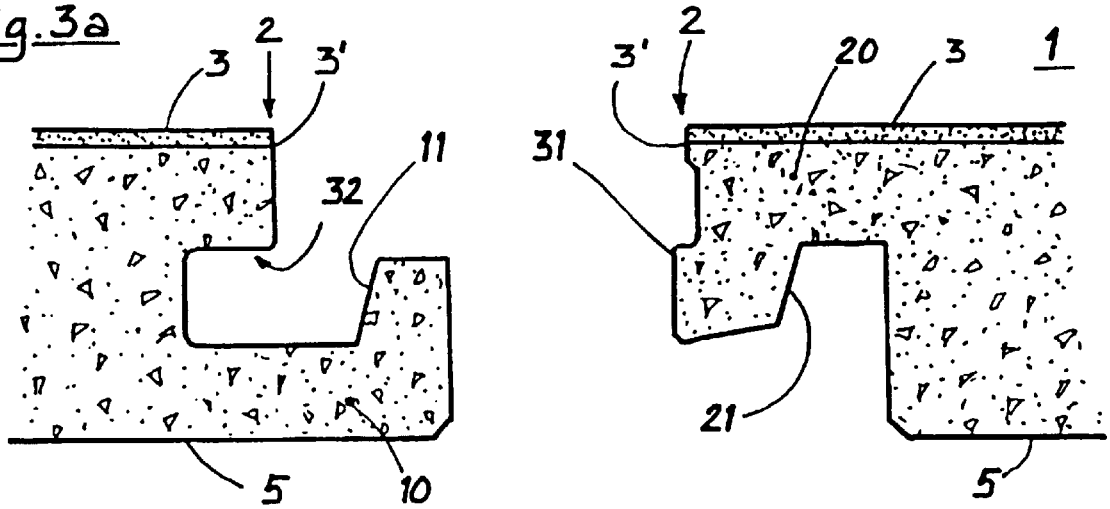
Figure 3B:
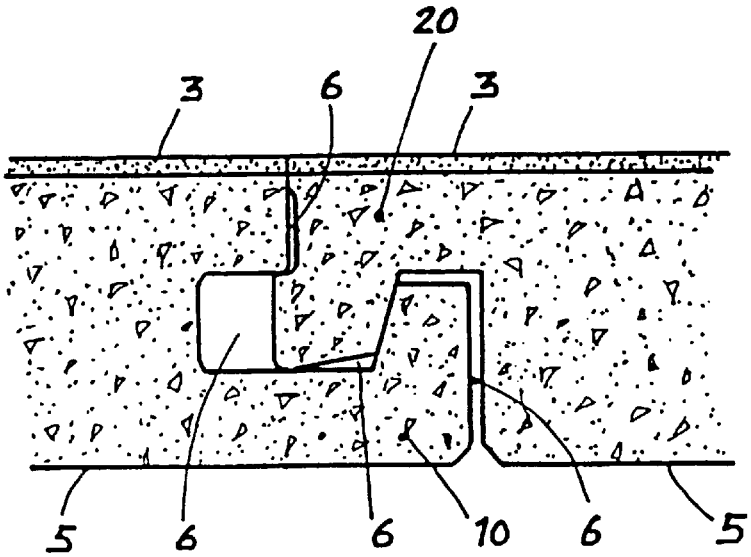

The FIGS. 3*a* and 3*b* show another embodiment of the invention. FIG. 3*a* shows, in cross-section the adjacent edges 2 of two floor boards 1 before joining while FIG. 3*b* shows the same after joining. The embodiment shown in FIGS. 3*a–b* is essentially the same as the one shown in FIG. 1. The embodiment shown in FIG. 3*a–b* is however also provided with cavities 6 (FIG. 3*b* ). The cavities 6 can for example be found in the finished joint between the contact surfaces that are formed between the horizontal locking surfaces on the recess 32 and the heel 31, the vertical upper lip surface 21 and the lower lip surface 11 together with the upper fitting surfaces 3'. The cavities 6 reduces the negative effects loose particles might have, which loose particles otherwise might cause undesired gaps in the upper part of the joint. The cross-section geometry of the joint is only shown schematically focusing on the interaction between the different surfaces in order to facilitate understanding of the invention. The invention is not limited to the embodiment as it can be varied within the scope of the invention.

Recesses of a greater depth, as shown in FIGS. 3*a* and 3*b*, is advantageously achieved by means of laser cutting or broaching. More shallow recesses, such as the ones shown in FIGS. 1 and 2*a–b* may be achieved by more traditional methods such as milling.

Figure 4:
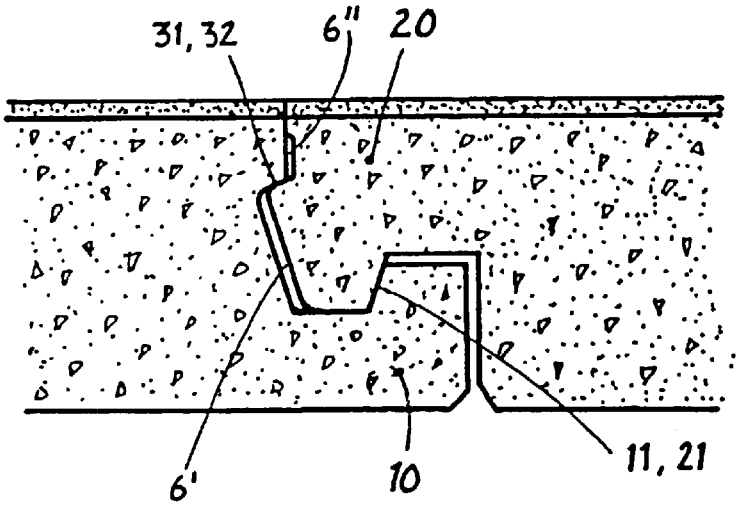
FIG. 4 shows a geometric variation of the embodiment of FIGS. 3*a* and 3*b*.

FIG. 4 shows a geometric variation of the embodiment shown in FIGS. 3*a*–3*b*. FIG. 4 shows in cross-section the adjacent edges 2 of two floor boards 1 after being joined. The embodiment shown in FIG. 4 is essentially the same as the one shown in FIGS. 3*a*–3*b* . The embodiment shown in FIG. 4 is, however, provided with somewhat inclined vertical surfaces on the recess 32 and the heel 31. The vertical surfaces of the cavity 6' is furthermore somewhat inclined while the height of the cavity 6' is increased and the depth is reduced. The height of the upper and the lower vertical lip surface 21 and 11 respectively is at the same time reduced while the height of the cavity 6" also is reduced. The geometry of the joint is hereby made more open so it will possible to manufacture by traditional methods such as milling.

Figure 5:
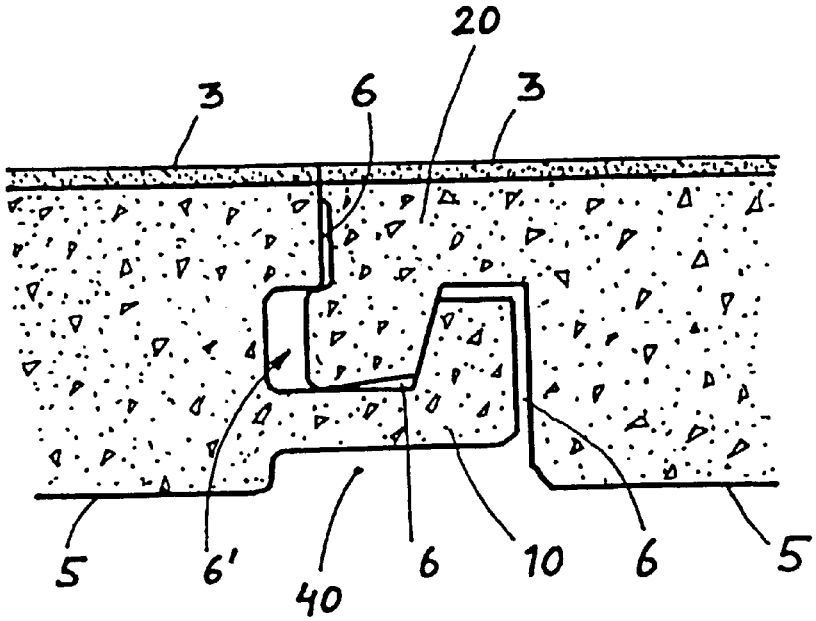
FIG. 5 shows a another geometric variation of the embodiment of FIGS. 3*a* and 3*b*.

FIG. 5 shows another geometric variation of the embodiment shown in FIGS. 3*a*–3*b* . FIG. 5 shows in cross-section the adjacent edges 2 of two floor boards 1 after being joined. The embodiment shown in FIG. 5 is essentially the same as the one shown in FIGS. 3*a*–3*b* . The embodiment shown in FIG. 5 is, however, provided with a cavity 6' with a reduced depth. A lower recess 40 is also introduced on the bottom of the lower joining lip 10. The lower recess 40 will allow the lower joining lip 10 to be bent downwards during the assembly, without having to touch the underlying surface.

What is claimed is:

1. Flooring material intended to be joined vertically comprising floor boards with an essentially square, rectangular or rhombodial shape, which floor boards comprise edges, horizontal lower side and a horizontal decorative upper surface, whereby the floor boards further comprise lower joining lips at two adjacent edges while the two remaining edges are provided with upper joining lips, the lower joining lips and upper joining lips each having a shape to permit assembly in a vertical direction, wherein the lower joining lips are provided with essentially vertical lower lip surfaces arranged parallel to the closest edge which lower lip surfaces are intended to interact with mainly vertical upper lip surfaces arranged on the upper joining lips so that two joined adjacent floor boards are locked together in a horizontal direction and that the joining lips are provided with one or more heels intended to snap join with recesses adapted thereto which, by being provided with essentially horizontal locking surfaces, limits vertical movement between two joined adjacent floor boards, whereby the floor boards are joinable by pressing vertically downwards a first floor board with respect a second floor board to mate the joining lips of the first floor board with the joining lips of the second floor board.

2. Flooring material intended to be joined vertically according to claim 1, characterized in that the joint between two floor boards (1) joined together includes fitting surfaces which are comprises by the horizontal locking surfaces on the recesses (32) and the heels (31), the vertical upper lip surfaces (11) and upper fitting surfaces (3').

3. Flooring material intended to be joined vertically according to claim 2, characterized in that the joint between two floor boards (1) joined together also includes cavities (6).

4. Flooring material intended to be joined vertically according to claim 3, characterized in that the heel (31) is constituted by a resilient part which is arranged in a cavity (6).

5. Flooring material intended to be joined vertically according to claim 3, characterized in that the recess (32) is constituted by a resilient part (7) which is arranged in a cavity (6).

6. Flooring material intended to be joined vertically according to claim 4, characterized in that the resilient part is constituted by an extruded thermoplastic profile.

7. Flooring material intended to be joined vertically according to claim 4, characterized in that the resilient part (7) is constituted by a profile made of thermosetting resin.

8. Flooring material intended to be joined vertically according to claim 4, characterized in that the resilient part (7) is constituted by a profile made of metal.

9. Flooring material intended to be joined vertically according to claim 5, characterized in that the resilient part is constituted by an extruded thermoplastic profile.

10. Flooring material intended to be joined vertically according to claim 5, characterized in that the resilient part (7) is constituted by a profile made of thermosetting resin.

11. Flooring material intended to be joined vertically according to claim 5, characterized in the resilient part (7) is constituted by a profile made of metal.

12. Flooring material intended to be joined vertically according to claim 1, wherein the floor boards are joinable by moving the first floor board straight downward from a plane parallel to a plane of the second floor board into the plane of the second floor board to mate the joining lips of the first floor board with the joining lips of the second floor board.

13. Flooring material comprising at least a first floor board and an adjacent second floor board, the first and second floor boards comprising edges permitting joining through vertical movement, wherein a joint between the first and second floor boards comprises:

fitting surfaces, including at least partially inclined vertical locking surfaces on recesses and heels and upper fitting surfaces, such that the joint between the first and second floor boards comprises a plurality of cavities, the first floor board comprising at least one lower joining lip, the lower joining lip comprising an essentially vertical lower lip surface arranged parallel to the closest edge, and such that a lower lip surface the first floor board may interact with a mainly vertical upper lip surface arranged on an upper joining lip of the second floor board to lock the first and second floor boards together in a horizontal direction, wherein the joining lips comprise at least one heel, adapted to snap join with the recess by means of the at least partially inclined vertical locking surfaces, whereby the vertical movement between two joined adjacent floor boards is limited.

14. Flooring material according to claim 13, wherein the first and second floorboards further comprise a core, the core consisting essentially of wood fibres or wood particles bonded together with glue, resin or a thermoplastic polymer.

15. Flooring material according to claim 14, wherein the core consists of 4–6 parts by weight of wood fibres or wood particles and 4–6 parts by weight of a thermoplastic polymer.

16. Flooring material according to claim 14, wherein the core contains an additive to improve the elastic and acoustic properties of the core.

17. Flooring material according to claim 14, wherein the joint is wholly made in the core.

18. Flooring material according to claim 13, further comprising glue between the first and second floor boards.

19. Flooring material according to claim 13, wherein the area closest to the joint of the floor boards are treated with at least one material selected from the group consisting of resin, wax and lacquer to protect the joint from moisture penetration.

20. Flooring material according to claims 13, wherein the floor boards comprise a decorative upper surface.

21. Flooring material, according to claim 20, wherein the decorative upper surface, comprises at least one selected from the group consisting of a decorative paper impregnated with melamine-formaldehyde resin and a decorative thermosetting laminate.

22. Flooring material according to claim 20, wherein the decorative upper surface comprises one selected from the group consisting of an acrylic foil, a foil of a polyolefin, a foil of a polyolefin derivative, an acrylic lacquer, and a lacquer of a polyolefin.

23. Flooring material according to claim 20, wherein the decorative upper surface comprises a polyolefin derivative.

* * * * *